US008936518B2

(12) United States Patent
Takechi

(10) Patent No.: US 8,936,518 B2
(45) Date of Patent: Jan. 20, 2015

(54) IRON GOLF CLUB HEAD

(75) Inventor: Takaharu Takechi, Shinagawa-ku (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 498 days.

(21) Appl. No.: 13/340,896

(22) Filed: Dec. 30, 2011

(65) Prior Publication Data

US 2012/0184390 A1 Jul. 19, 2012

(30) Foreign Application Priority Data

Jan. 19, 2011 (JP) ..... 2011-008994

(51) Int. Cl.
*A63B 53/04* (2006.01)

(52) U.S. Cl.
CPC ..... *A63B 53/047* (2013.01); *A63B 2209/00* (2013.01)
USPC ..... 473/335; 473/347; 473/350

(58) Field of Classification Search
USPC ..... 473/324–350
See application file for complete search history.

(56) References Cited

U.S. PATENT DOCUMENTS 632,885 A * 9/1899 Sweny ..... 473/329
2,460,435 A * 2/1949 Schaffer ..... 473/332
3,941,390 A * 3/1976 Hussey ..... 473/292
4,313,607 A * 2/1982 Thompson ..... 473/328
4,523,759 A * 6/1985 Igarashi ..... 473/346
4,553,755 A * 11/1985 Yamada ..... 473/338
4,614,627 A * 9/1986 Curtis et al. ..... 264/46.6
4,690,408 A * 9/1987 Kobayashi ..... 473/349
4,697,814 A * 10/1987 Yamada ..... 473/348
4,793,616 A * 12/1988 Fernandez ..... 473/347
4,803,023 A * 2/1989 Enomoto et al. ..... 264/45.4
5,184,823 A * 2/1993 Desboilles et al. ..... 473/345
5,242,168 A * 9/1993 Aizawa ..... 473/332
5,301,945 A * 4/1994 Schmidt et al. ..... 473/311
5,306,450 A * 4/1994 Okumoto et al. ..... 264/45.1
5,328,175 A * 7/1994 Yamada ..... 473/346
5,447,311 A * 9/1995 Viollaz et al. ..... 473/342
5,456,469 A * 10/1995 MacDougall ..... 473/328
5,472,201 A * 12/1995 Aizawa et al. ..... 473/329
5,499,819 A * 3/1996 Nagamoto ..... 473/346
5,509,659 A * 4/1996 Igarashi ..... 473/345

(Continued)

FOREIGN PATENT DOCUMENTS

JP 60-81565 U 6/1985
JP 61-133069 U 8/1986

(Continued)

OTHER PUBLICATIONS

Japanese Office Action, dated Jul. 1, 2014, issued in corresponding Japanese Patent Application No. 2011-008994.

*Primary Examiner* — Alvin Hunter
(74) *Attorney, Agent, or Firm* — Sughrue Mion, PLLC

(57) ABSTRACT

An iron golf club head includes a hosel part embedded member installed in a hosel part thereof, a sole part embedded member installed in a sole part thereof, and a top part embedded member installed in an upper portion of a face part of thereof. In a shank part (neck part) connecting the hosel part to the body part, a connecting embedded member for connecting the hosel part embedded member to the sole part embedded member is installed. These embedded members are covered with a synthetic resin layer. The hosel part embedded member and the connecting embedded member each are preferably made of a metal.

10 Claims, 3 Drawing Sheets

(56) References Cited

U.S. PATENT DOCUMENTS

| | | | | | |
|---|---|---|---|---|---|
| 5,876,293 | A * | 3/1999 | Musty | 473/341 |
| 6,010,411 | A * | 1/2000 | Reyes | 473/345 |
| 6,030,294 | A * | 2/2000 | Shira | 473/342 |
| 6,302,804 | B1 * | 10/2001 | Budde | 473/251 |
| 6,692,376 | B2 * | 2/2004 | Kosovac et al. | 473/312 |
| 6,923,733 | B2 * | 8/2005 | Chen | 473/305 |
| 7,008,331 | B2 * | 3/2006 | Chen | 473/342 |
| 7,303,485 | B2 * | 12/2007 | Tseng | 473/332 |
| 7,744,486 | B2 * | 6/2010 | Hou et al. | 473/329 |
| 8,088,025 | B2 * | 1/2012 | Wahl et al. | 473/346 |
| 8,152,651 | B2 * | 4/2012 | Roach | 473/329 |

FOREIGN PATENT DOCUMENTS

| | | | | | |
|---|---|---|---|---|---|
| JP | 61-249484 | A | | 11/1986 | |
| JP | 01131682 | A | * | 5/1989 | A63B 53/04 |
| JP | 01190374 | A | * | 7/1989 | A63B 53/04 |
| JP | 02021882 | A | * | 1/1990 | A63B 53/04 |
| JP | 02124182 | A | * | 5/1990 | A63B 53/04 |
| JP | 02167181 | A | * | 6/1990 | A63B 53/04 |
| JP | 02180282 | A | * | 7/1990 | A63B 53/04 |
| JP | 03007178 | A | * | 1/1991 | A63B 53/04 |
| JP | 03295572 | A | * | 12/1991 | A63B 53/04 |
| JP | 7-148286 | A | | 6/1995 | |
| JP | 07148286 | A | * | 6/1995 | A63B 53/04 |
| JP | 11047325 | A | * | 2/1999 | A63B 53/04 |
| JP | 7-67990 | A | | 3/1999 | |
| JP | 11-76477 | A | | 3/1999 | |
| JP | 2003-325710 | A | | 11/2003 | |
| JP | 2004313777 | A | * | 11/2004 | A63B 53/04 |
| JP | 2005095244 | A | * | 4/2005 | A63B 53/04 |
| JP | 2005095245 | A | * | 4/2005 | A63B 53/04 |
| JP | 2005095246 | A | * | 4/2005 | A63B 53/04 |
| JP | 2009-89768 | A | | 4/2009 | |

* cited by examiner

IRON GOLF CLUB HEAD

CROSS-REFERENCE TO RELATED APPLICATION

This Application claims priority from Japanese Patent Application No. 2011-8994 filed Jan. 19, 2011, which is incorporated herein by reference in its entirety.

BACKGROUND OF THE INVENTION

The present invention relates to an iron golf club head.

As a golf club, there have been used not only a wood such as a driver and a fairway wood, and an iron mainly used for a shot from a fairway, the rough, a bunker, and the like, but also a utility club having a shape similar to the shapes of a wood and an iron, and furthermore a putter and the like clubs.

For the widely used iron head, a portion ranging from a face part to a hosel part has been made of stainless steel, carbon steel, one of various kinds of alloys, or the like metal. Japanese Patent Application Publication No. 2003-325710 (see section [0011] and FIG. 3) describes an iron golf club head in which the face part thereof is composed of a metal plate, the body part thereof other than the face part is made of a synthetic resin, and a metallic face plate is fitted on the face surface of the synthetic resin-made body part.

SUMMARY OF THE INVENTION

For the metal-made iron head, the degree of freedom in designing the head shape, the position of center of gravity, and the like factors is small. For the head disclosed in Japanese Patent Application Publication No. 2003-325710 in which the body part is made of a synthetic resin, it is thought that the strength is low, and therefore the practical use thereof is extremely difficult.

An object of the present invention is to provide an iron golf club head that has a high degree of freedom in designing the head shape, the position of center of gravity, and the like factors, and moreover has a high strength.

An iron golf club head according to the present invention includes an embedded member for reinforcement or weight control and a synthetic resin layer for covering the embedded member.

The embedded member may include at least a sole part embedded member installed in the sole part of the iron golf club head and a hosel part embedded member installed in the hosel part thereof. A hosel hole may be formed in the hosel part embedded member.

The sole part embedded member and the hosel part embedded member may be connected to each other via a connecting embedded member.

The sole part embedded member, the hosel part embedded member, and the connecting embedded member each may be made of a metal.

The embedded member may further include a top part embedded member installed in the upper portion of a face part of the iron golf club head.

An outer surface of the synthetic resin layer may be metal plated.

The iron golf club head in accordance with the present invention has the embedded member for reinforcement or weight control and the synthetic resin layer for covering the embedded member, and the shape, material, and the like of the embedded member can be selected widely. For the synthetic resin layer, layers having various shapes can be formed easily. Therefore, the iron golf club head in accordance with the present invention has a high degree of freedom of design.

In the present invention, by using the reinforcing embedded member, the strength of the iron golf club head can be enhanced sufficiently. For example, by installing the hosel part embedded member, which has the hosel hole, in the hosel part, the strength of the hosel part can be enhanced. By connecting the sole part embedded member and the hosel part embedded member to each other via the connecting embedded member, the strength of a portion ranging from the sole part to the hosel part can be enhanced.

By installing the top part embedded member in the upper portion of the face part, the upper portion of the face part can be reinforced, or the moment of inertia of the head can be controlled. Also, by using a high-density material as the sole part embedded member 8, the center of gravity of the iron golf club head can be lowered.

DESCRIPTION OF THE PREFERRED EMBODIMENTS

Figure 1:
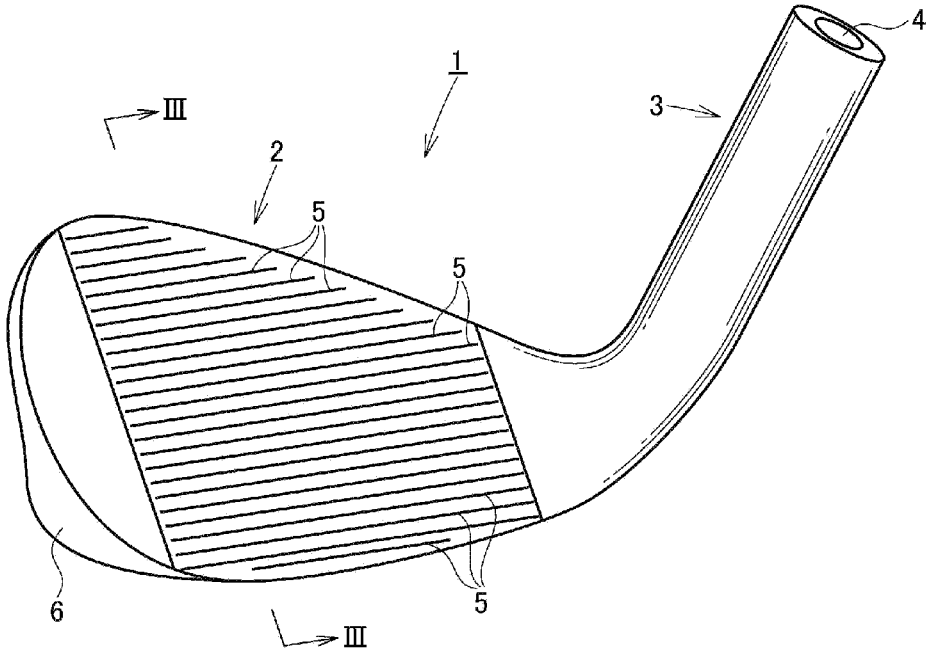
FIG. 1 is a perspective view of an iron golf club head in accordance with an embodiment of the present invention.
Figure 2:
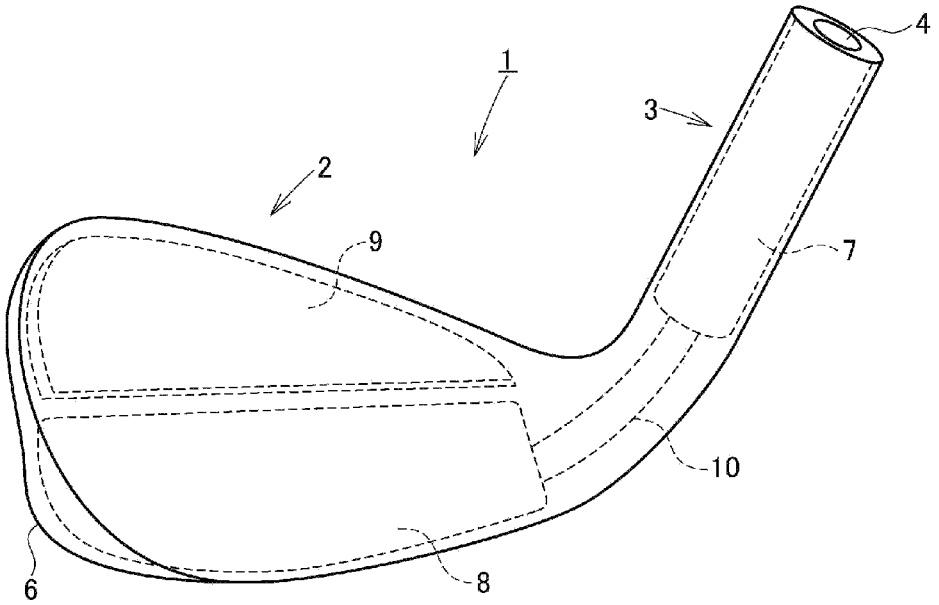
FIG. 2 is a configuration view showing the interior of the iron golf club head shown in FIG. 1.
Figure 3:
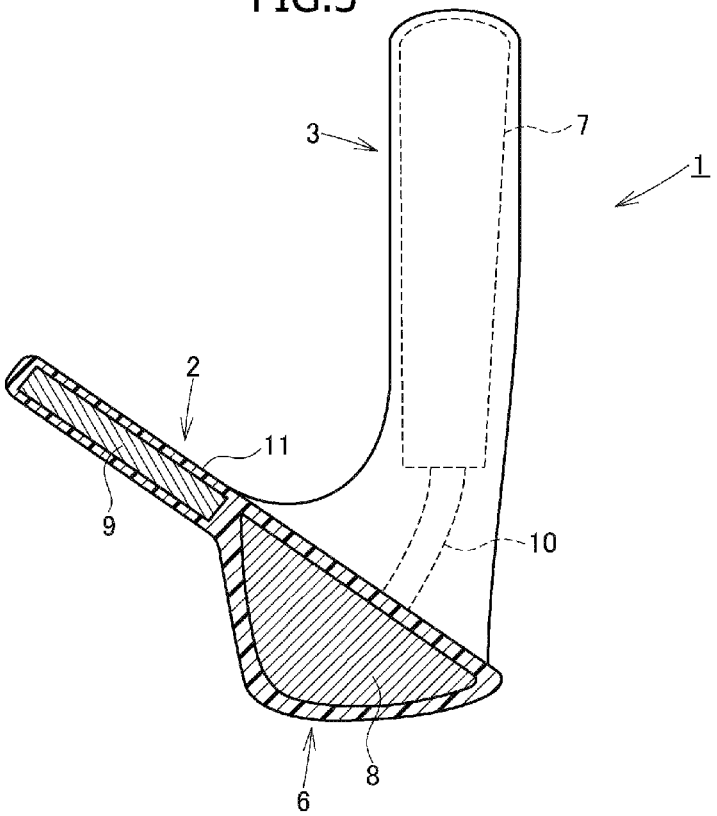
FIG. 3 is a sectional view taken along the line III-III of FIG. 1.

Embodiments of an iron golf club head according to the present invention will now be described with the accompanying drawings. A first embodiment of the present invention is illustrated in FIGS. 1 to 3.

An iron golf club head 1 includes a body part 2 for hitting a ball and a hosel part 3 connecting with the body part 2. The hosel part 3 is formed with a hosel hole 4 into which a shaft is inserted. The front surface of the body part 2 is a face surface, and a large number of score lines (grooves) 5 are provided thereon. The lower portion of the body part 2 serves as a sole part 6 having a shape expanding to the rear.

In this iron golf club head 1, a hosel part embedded member 7 is installed in the hosel part 3, a sole part embedded member 8 is installed in the sole part 6, and a top part embedded member 9 is installed in the upper portion of the body part 2 or face part. The hosel hole 4 is formed in the hosel part embedded member 7. Also, in a shank part (neck part) connecting the body part 2 and the hosel part 3 to each other, a connecting embedded member 10 that connects the hosel part embedded member 7 to the sole part embedded member 8 is installed. These embedded members 7 to 10 are covered with a synthetic resin layer 11. The synthetic resin layer 11 covers the embedded members 7 to 10 on the entire head outer surface excluding the inner peripheral surface of the hosel hole 4 in the hosel part embedded member 7.

The hosel part embedded member 7 and the connecting embedded member 10 may be made of a metal such as maraging steel, stainless steel, carbon steel, titanium, titanium alloy, aluminum alloy, or magnesium alloy. In particular, the hosel part embedded member 7 is preferably made of aluminum alloy or magnesium alloy, which has a lower specific gravity, for preventing the position of center of gravity of the head from shifting to a heel of the head and for easily designing a position of center of gravity. In the case in which all of the hosel part embedded member 7, the sole part embedded member 8, and the connecting embedded member 10 are made of a metal, the connecting embedded member 10 is preferably connected to the embedded members 7 and 8 by welding or the like means. The connecting embedded member 10 is preferably of a rod shape or a pipe shape, but it may be of a plate shape.

The sole part embedded member 8 may be made of a metal such as tungsten, tungsten alloy, copper, or copper alloy as well as the above-described metals for lowering the position of center of gravity of the head. In addition, a ceramic material and a high-density synthetic resin can also be used. Exemplary high-density synthetic resins include a synthetic resin containing metal powder such as tungsten, tungsten alloy, copper, or copper alloy.

The top part embedded member 9 is preferably made of a material having a lower specific gravity than the material for the sole part embedded member 8. Exemplary materials for the top part embedded member 9 include a fiber-reinforced resin and a ceramic material as well as a metal such as titanium, titanium alloy, aluminum, aluminum alloy, magnesium, or magnesium alloy.

Exemplary synthetic resins for the synthetic resin layer 11 include a thermoplastic resin such as acrylonitrile-butadiene-styrene (ABS) and polycarbonate.

The surface of the synthetic resin layer 11 may be metal plated. By the metal plating, the weather resistance, water resistance, chemical resistance, corrosion resistance, and wear resistance of the surface of the synthetic resin layer 11 can be raised. As a metal for metal plating, chromium, nickel, and copper are suitable. As the plating method, electroless plating or electroplating can be accomplished. For example, after being subjected to electroless nickel plating, the surface can be nickel plated by electroplating, and thereby, a thickness of the plating can be easily increased. To upgrade the adhesive property of metal plating, the surface of the synthetic resin layer 11 may be roughened.

The iron golf club head 1 has the embedded members 7 to 10 and the synthetic resin layer 11 for covering the embedded members 7 to 10, and the shape, material, and the like of each of the embedded members 7 to 10 can be selected widely. For the synthetic resin layer 11, one of layers having various shapes can be formed easily by injection molding. Therefore, the head 1 has a high degree of freedom of design. Also, by using the hosel part embedded member 7 and the connecting embedded member 10, the strengths of the hosel part 3 and the shank part can also be enhanced sufficiently. By using a high-density material as the sole part embedded member 8, the center of gravity of the head can be lowered. Since the top part embedded member 9 is installed in the upper portion of the body part 2, the upper portion of the body part 2 can be reinforced, or the moment of inertia of the head 1 can be controlled.

The iron golf club head 1 in accordance with the present invention can easily be manufactured by placing the embedded members 7 to 10 in a mold, by forming the synthetic resin layer 11 by injecting a synthetic resin, and thereafter by performing plating as necessary. The manufacturing method for this iron golf club head 1 is carried out easily as compared with the manufacturing method for the conventional iron head using casting or forging procedures.

This iron golf club head 1 is completed by inserting the shaft into the hosel hole 4 in the iron golf club head 1, and by fixing the shaft with an adhesive.

Figure 4:
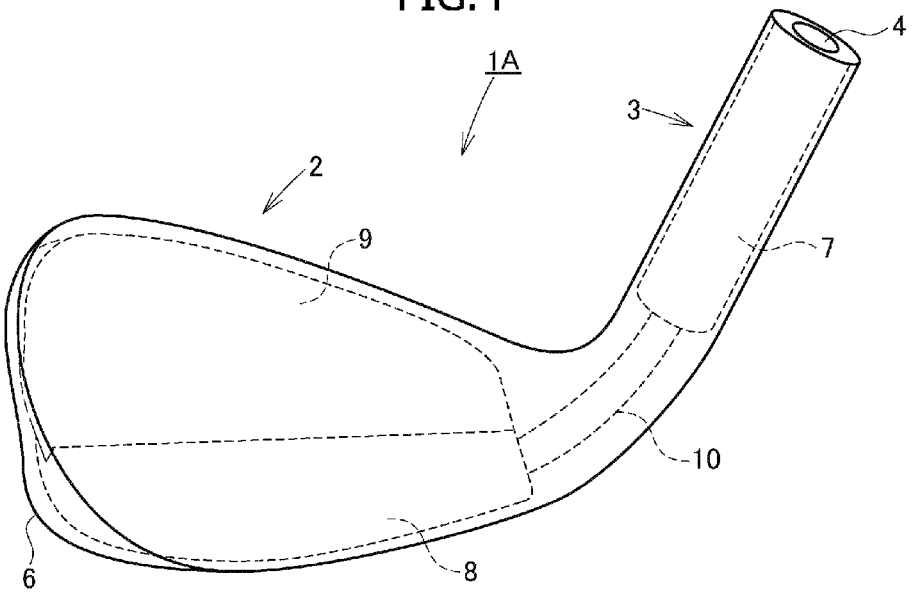
FIG. 4 is a configuration view showing the interior of an iron golf club head in accordance with another embodiment of the present invention.
Figure 5:
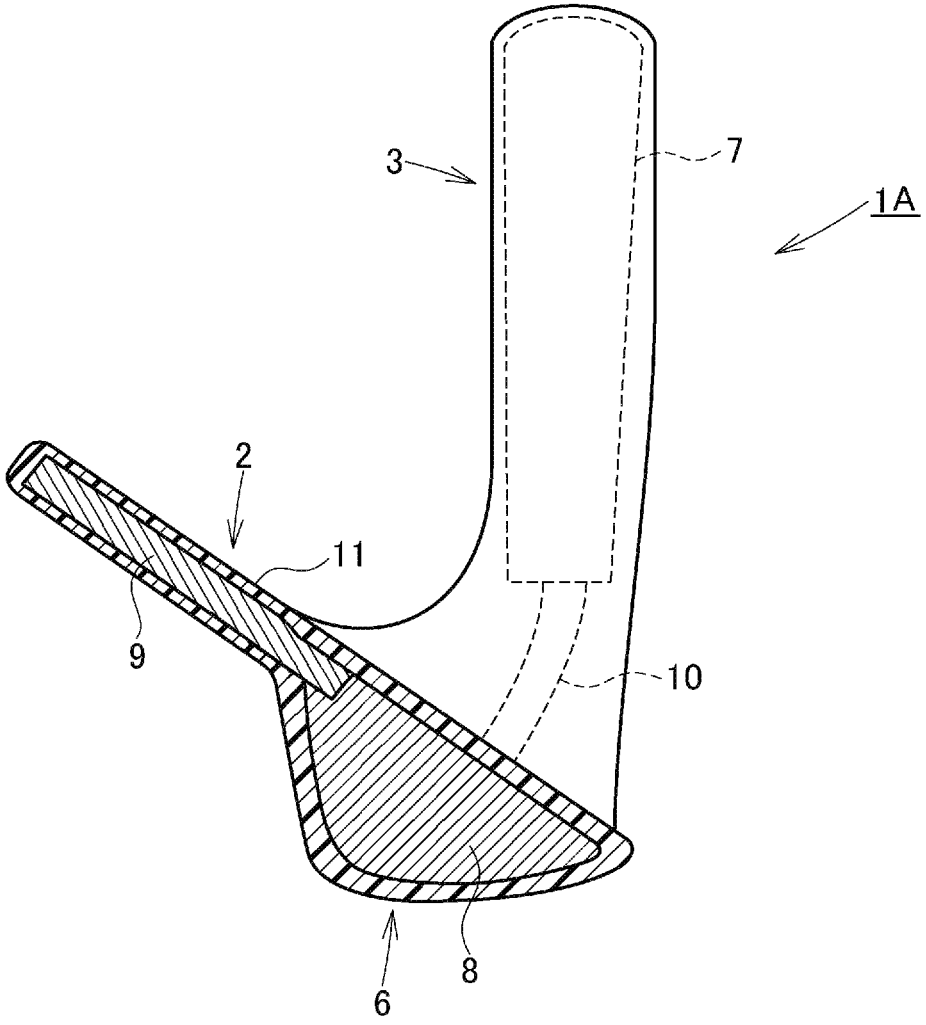
FIG. 5 is a sectional view of the iron golf club head shown in FIG. 4.

In the above-described iron golf club head 1, the top part embedded member 9 is somewhat separated from the sole part embedded member 8. In the present invention, however, the top part embedded member 9 and the sole part embedded member 8 may be connectedly integrated by using an adhesive or the like as in the case of an iron golf club head 1A in accordance with a second embodiment shown in FIGS. 4 and 5. In the second embodiment, a concave step portion is provided on the upper portion face surface side of the sole part embedded member 8, and the lower portion of the top part embedded member 9 is extended and engaged with the concave step portion. The front surfaces of the top part embedded member 9 and the sole part embedded member 8 are in a flush form.

The iron golf club heads 1 and 1A shown in the drawings have the same appearance shape as that of the conventional iron head. Therefore, the present invention can be applied to an iron utility head having an appearance shape similar to that of the iron head.

What is claimed is:

1. An iron golf club head comprising:

an embedded member for reinforcement or weight control; and a synthetic resin layer for covering the embedded member, wherein the embedded member comprises:

a sole part embedded member installed in a sole part of the iron golf club head, the sole part embedded member being made of a first material;

a hosel part embedded member installed in a hosel part of the iron golf club head, a hosel hole being formed in the hosel part embedded member; and a top part embedded member installed in an upper portion of a face part of the iron golf club head, the top part embedded member being made of a second material, wherein the first material of the sole part embedded member has a higher density than the second material of the top part embedded member.

2. The iron golf club head according to claim 1, wherein the sole part embedded member and the hosel part embedded member are connected to each other via a connecting embedded member.

3. The iron golf club head according to claim 2, wherein the sole part embedded member, the hosel part embedded member, and the connecting embedded member are each made of a metal.

4. The iron golf club head according to claim 1, wherein an outer surface of the synthetic resin layer is metal plated.

5. The iron golf club head according to claim 1, wherein the first material of the sole part embedded member is a metal material selected from the group consisting of tungsten, tungsten alloy, copper, and copper alloy.

6. The iron golf club head according to claim 1, wherein the first material of the sole part embedded member is a ceramic material.

7. The iron golf club head according to claim 1, wherein the first material of the sole part embedded member is a synthetic resin containing metal powder selected from the group consisting of tungsten, tungsten alloy, copper, and copper alloy.

8. The iron golf club head according to claim 1, wherein the second material of the top part embedded member is a metal material selected from the group consisting of titanium, titanium alloy, aluminum, aluminum alloy, magnesium, and magnesium alloy.

9. The iron golf club head according to claim 1, wherein the second material of the top part embedded member is a fiber-reinforced resin.

10. The iron golf club head according to claim 1, wherein the second material of the top part embedded member is a ceramic material.

* * * * *